US009062602B2

(12) United States Patent
Casey

(10) Patent No.: US 9,062,602 B2
(45) Date of Patent: Jun. 23, 2015

(54) METHOD AND MEANS FOR CONTROLLING COMBUSTION

(75) Inventor: Alan Patrick Casey, Queensland (AU)

(73) Assignee: JBEC PTY LIMITED, Queensland (AU)

( * ) Notice: Subject to any disclaimer, the term of this patent is extended or adjusted under 35 U.S.C. 154(b) by 0 days.

(21) Appl. No.: 13/879,957

(22) PCT Filed: Oct. 17, 2011

(86) PCT No.: PCT/AU2011/001322

§ 371 (c)(1),
(2), (4) Date: Apr. 17, 2013

(87) PCT Pub. No.: WO2012/051645

PCT Pub. Date: Apr. 26, 2012

(65) Prior Publication Data

US 2013/0206113 A1 Aug. 15, 2013

(30) Foreign Application Priority Data

Oct. 19, 2010 (AU) ..... 2010904668

(51) Int. Cl.

| | |
|---|---|
| ***F02B 75/28*** | (2006.01) |
| ***F02B 25/10*** | (2006.01) |
| ***F01B 7/14*** | (2006.01) |
| *F02B 75/02* | (2006.01) |

(52) U.S. Cl.

CPC ..... *F02B 75/28* (2013.01); *F02B 2075/025* (2013.01); *F02B 75/282* (2013.01); *F02B 2075/027* (2013.01); *F02B 25/10* (2013.01); *F01B 7/14* (2013.01)

(58) Field of Classification Search

CPC .. F02B 75/28; F02B 2075/027; F02B 75/282; F02B 2075/025; F01B 7/14

USPC ..... 123/51 R

See application file for complete search history.

(56) References Cited

U.S. PATENT DOCUMENTS

| | | | | | |
|---|---|---|---|---|---|
| 1,940,533 | A | * | 12/1933 | Cain | 123/51 |
| 4,305,349 | A | * | 12/1981 | Zimmerly | 123/51 |
| 4,635,590 | A | * | 1/1987 | Gerace | 123/27 R |
| 5,713,314 | A | * | 2/1998 | Beare | 123/51 R |
| 2006/0243228 | A1 | | 11/2006 | Tour | |

FOREIGN PATENT DOCUMENTS

| | | | | |
|---|---|---|---|---|
| DE | 577234 | C | | 5/1933 |
| JP | 10339166 | A | * | 12/1998 |

OTHER PUBLICATIONS

International Search Report for corresponding International Application No. PCT/AU2011/001322.

* cited by examiner

*Primary Examiner* — Lindsay Low
*Assistant Examiner* — Charles Brauch
(74) *Attorney, Agent, or Firm* — Egbert Law Offices, PLLC

(57) ABSTRACT

A method of charging an internal combustion engine with a fuel air mixture, the engine having opposed pistons with a combustion chamber therebetween, wherein the method includes forcing induction air during a compression stroke between a first and a second cylinder via a contraction and expansion or a venturi disposed between the first and second pistons.

11 Claims, 11 Drawing Sheets

METHOD AND MEANS FOR CONTROLLING COMBUSTION

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a method and means for controlling combustion in internal combustion engines and more particularly in internal combustion engines generally configured as disclosed in WO96/12096 and WO2004/007911, the contents of which are incorporated herein by reference.

Throughout this description and the claims which follow, unless the context requires otherwise, the word "comprise", or variations such as "comprises" or "comprising", will be understood to imply the inclusion of a stated integer or step or group of integers or steps.

The reference to any prior art in this specification is not, and should not be taken as, an acknowledgment or any form of suggestion that that prior art forms part of the common general knowledge in Australia.

In this specification an internal combustion engine is defined as an internal combustion engine having opposed pistons with a combustion chamber therebetween as disclosed in WO96/12096 or WO2004/007911

As used herein "first" and "second" piston have the same meaning as in WO96/12096. In the environment of an internal combustion engine the first piston may be considered a power piston and the second piston a valving or timing piston associated with the opening and closing of inlet and exhaust gas flows. Typically, the timing piston need only be of sufficient diameter to allow intake and exhaust openings to comply with the well understood design criteria for longevity and good design requirements for 2-stroke induction and exhaust systems. The second cylinder and piston form part of the intake and exhaust manifold and may be treated as such in calculating ram and scavenging effects.

2. Description of Related Art Including Information Disclosed Under 37 CFR 1.97 and 37 CFR 1.98.

Prototypes in accordance with the prior art arrangements as shown in WO96/12096 and WO2004/007911 function in an adequate manner but have some deficiencies as regards the quality and efficiency of induction, exhaust and combustion.

BRIEF SUMMARY OF THE INVENTION

With a view to aiding the performance and efficiency of the related prior art arrangements when operated as an internal combustion engine, the present invention proposes a method and means for controlling induction of an air and fuel mixture into the combustion chamber formed between the first and second pistons. In that regard the present invention is concerned with the characteristics of the passage between the first and second pistons so as to achieve a desired gas flow into and out of that passage. The passage is also adapted to form a significant portion of the combustion chamber in the space between the two pistons.

In accordance with a first aspect of the present invention there is provided a method of charging an internal combustion engine as disclosed in WO96/12096 or WO2004/007911 with a fuel air mixture wherein induction air, during a compression stroke, is forced between the first and second cylinders via a contraction and expansion between the first and second pistons.

Preferably, mixing of fuel and intake air occurs within the contraction and expansion between the second and first cylinders.

It is further preferred that fuel be injected into a zone between the contraction and expansion.

In accordance with a second aspect of the present invention there is provided an internal combustion engine as disclosed in WO96/12096 or WO2004/007911 wherein a passage incorporating a venturi joins the first and second cylinders such that induction air is compressed in the passage as the first and second pistons move toward each other during a compression stroke In a preferred form the passage between the two pistons, commencing from the cylinder of the second piston, leads into a first conical bore contracting toward the first piston to as zone of minimum cross-sectional area and from that zone a second conical bore expands to open into the cylinder of the first piston. The minimum cross-sectional area zone forms a tuning region for the intake fluid flow between the second and first pistons and which zone acts in a manner akin to that of an intake poppet valve of a conventional four-stroke internal combustion engine. The pressure drop across the zone determining a best operating speed of the engine by allowing a maximum ram effect at the predetermined best operating speed. The contraction then expansion of the passage provides a venturi effect which is advantageous to induction.

The shape of the zone can take any form that is suited to a desired mode of initial combustion for the engine.

Preferably, the minimum cross-sectional area zone is generally oval shaped as viewed in the direction of gas flow between the pistons. That oval shape has particular advantages when the engine is operated as a diesel engine with direct injection.

Preferably, the volume of the passage between the two pistons is approximately a third of the compressed volume of the engine when the first piston is at top dead centre (TDC). Such an arrangement is considered to provide benefits when direct injecting liquids so that they premix with a relatively smaller volume of compressed air when compared with the operation of a conventional internal combustion engine.

Preferably, the oval shaped zone is fitted with a pintle projecting thereinto which is adapted to retain heat and aid combustion in diesel engines. Typically, the pintle can be of stainless steel or any other suitable material.

In a further preferred embodiment, a direct injection of fuel is provided into the oval, shaped zone in the direction of the major axis of the oval shape. Still further, it is preferred that the pintle projects into the oval shaped region along the major axis but opposite to the direction of injection of fuel.

Preferably, the head of the first piston is shaped as at least a partial complementary fit within the second conical bore such that varying that shape across a range of alternate pistons leads to readily altering the compression ratio of the engine by a change of first pistons.

Preferably, the top of the second piston, which is inverted relative to the first piston, is shaped as a frustum of a cone adapted to mate with a. complementary conical shape, preferably being a portion of the venturi, at the top of the second cylinder when the second piston is at its TDC. This relationship assists in allowing a thorough mixing of the air and any entrained atomised fuel.

A small oval shaped chamber of preferred embodiments also allows for establishment of a desirable flame front before the hot gasses force their way out of the oval shaped chamber into the remaining compressed volume within the combustion chamber. The established flame front expands into the expanding conical shape and then into the adjacent first cylinder, as the bottom or first piston moves away from TDC, creating substantial turbulence which provides good conditions for movement of the flame front into the remaining air within the combustion chamber.

During an exhaust stroke the spent gasses have to again pass through the venturi space between the first and second cylinders and so generate swirl and turbulence as they flow into the second cylinder on their way to an exhaust port revealed by movement of the second piston away from its TDC.

In one embodiment a particular type of injector under consideration has a spray angle of 155 degrees; a common rail type 30,000 psi pump is fitted. to spray into the zone or chamber between the contraction and expansion so as to generate a fan shaped spray spreading out into the oval shape. A further advantage of the oval shape is that upon movement of air therethrough or thereinto on a compression stroke of the engine, a double swirl pattern may be generated.

BRIEF DESCRIPTION OF THE DRAWINGS

The present invention will now be described by way of example with reference to the accompanying drawings, in which:—

FIG. 5 A is a magnification of the circled section of FIG. 5;

DETAILED DESCRIPTION OF THE INVENTION

Figure 1:
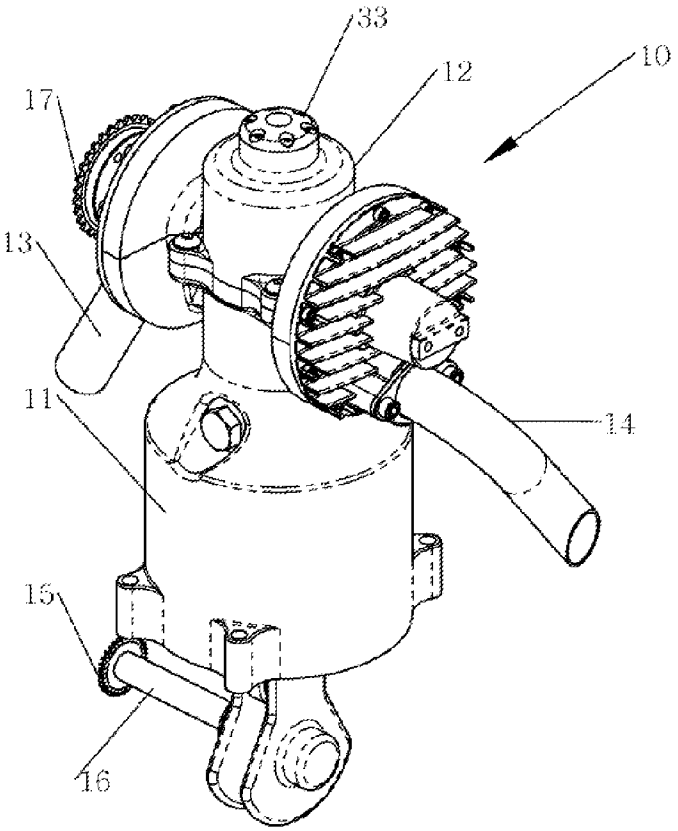
FIG. 1 is a perspective view of a single cylinder engine in accordance with an embodiment of the present invention.
Figure 3:
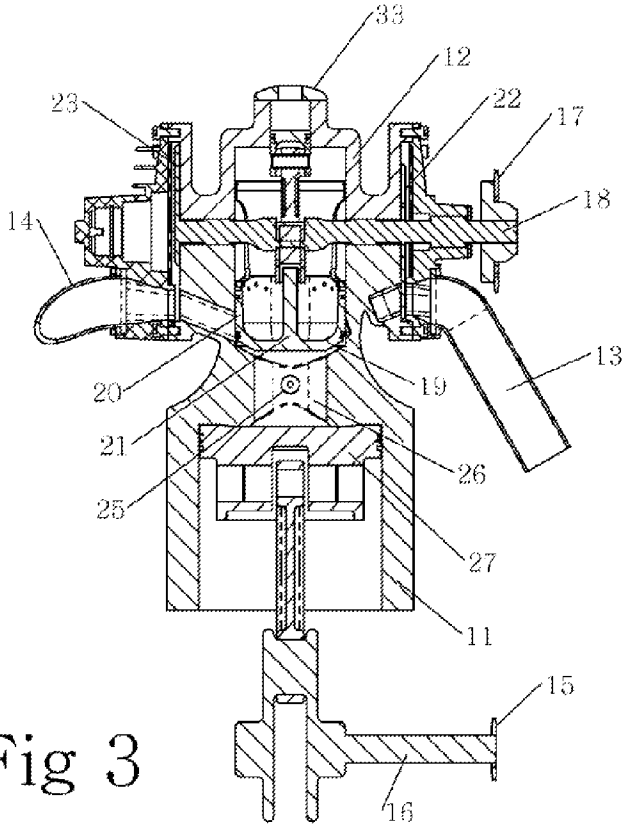
FIG. 3 is a section view III-III of FIG. 2.
Figure 2:
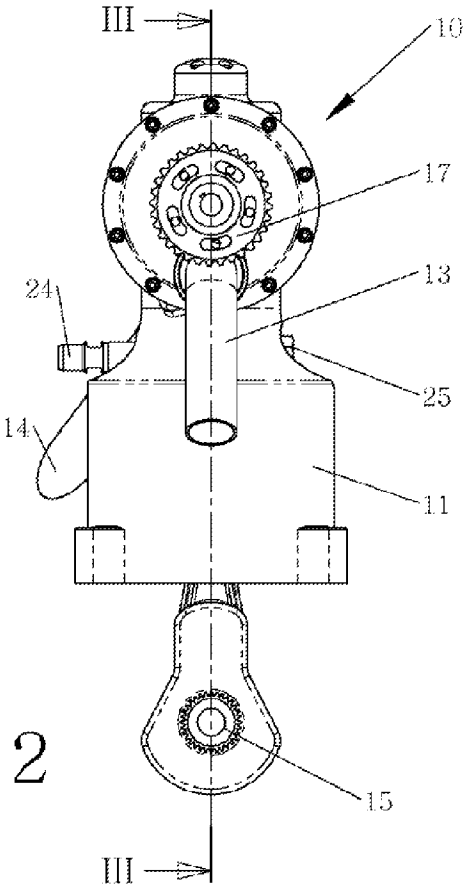
FIG. 2 is a front elevation view of the embodiment of FIG. 1 viewed from the inlet port side thereof.

The embodiment shown in the drawings is of a single cylinder pair, direct injection diesel engine 10 having a lower or first cylinder 11, an upper or second cylinder 12, an air intake 13 and exhaust pipe 14 disposed either side of upper cylinder 12. Sprocket 15 mounted on lower or first crankshaft 16 is aligned with sprocket 17 on upper or second crankshaft 18 which controls the opening and closing of inlet and exhaust ports 19 and 20, respectively, via motion of second piston 21 and rotary porting discs 22, 23. A drive chain (not shown) runs between sprockets 15 and 17 and the drive ratio therebetween is 2:1 for this 4-cycle engine.

Figure 6:
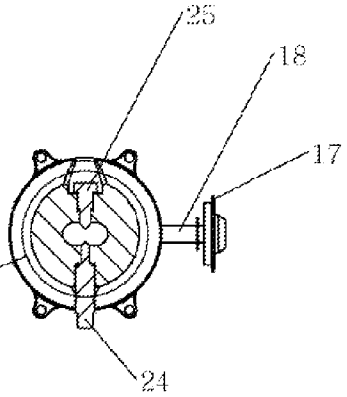
FIG. 6 is a section view VI-VI of FIG. 4.
Figure 6A:
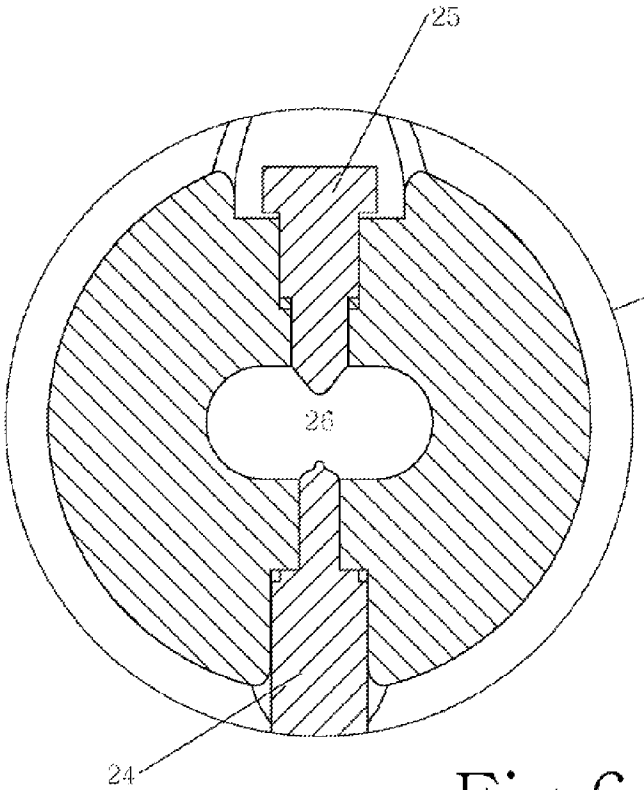
FIG. 6A is a magnification of the major part of FIG. 6.

A fuel injector 24 and pintle 25 are mounted within chamber or passage 26 between cylinders 11 and 12 which house first piston 27 and second piston 21. Passage 26 includes conical contracting portions 28, 29 leading from cylinders 11 and 12, respectively, toward central one 30 defining the minimum cross-sectional area of passage 26. In this particular embodiment central zone of passage 26 is of an oval cross-sectional shape, as viewed in the direction of flow between cylinders 11 and 12 (FIGS. 6, 6A), and has injector 24 and pintle 25 disposed in diametrically opposed positions therewithin along the minor axis of the oval shape.

Figure 5A:
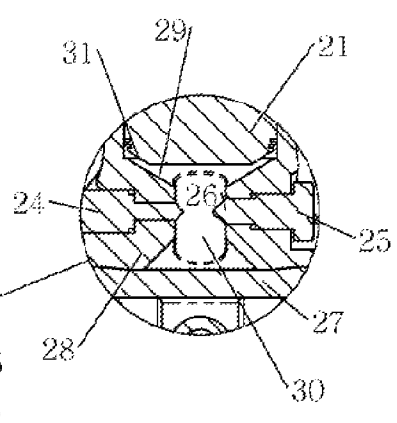
FIG. 5 is a section view V-V of FIG. 4.
Figure 5:
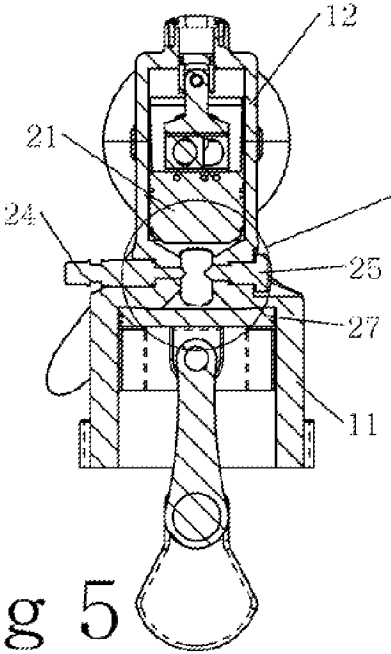
Figure 4:
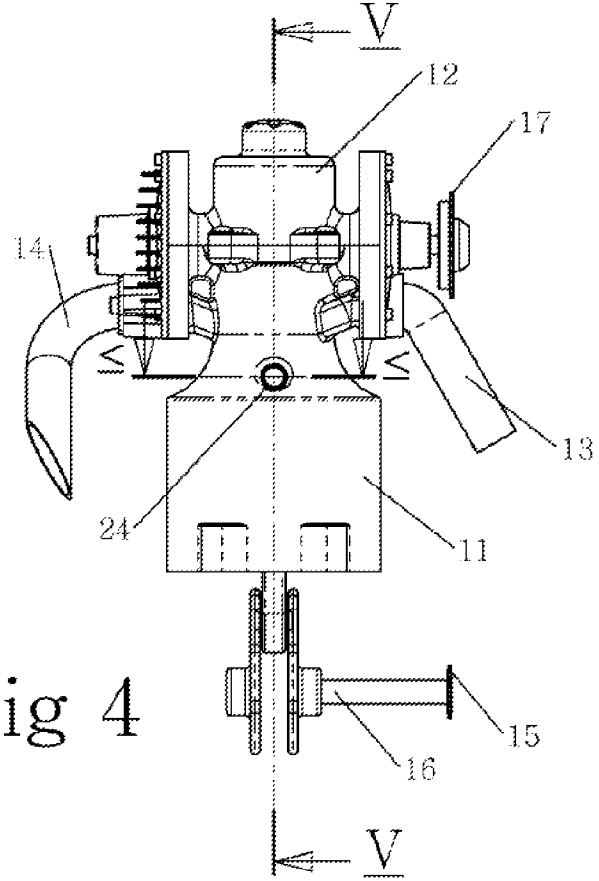
FIG. 4 is a side elevation view of the embodiment of FIG. 1.

As shown in FIGS. 5 and 5A, the first piston is at TDC within cylinder 11 while inverted second piston 21 is similarly located within cylinder 12. In this position, a boundary of oval-shaped central one 30 within conical contracting portion 29 is at or near the TDC position of inverted second piston 21. The positioning of second piston 21 relative to first piston 27 may be varied as desired. It is preferred that the TDC position of piston 21 coincides with an adjacent edge of central zone 30 where frusto-conical head portion 31 of piston 21 mates with conical portion 29 of one contraction/expansion of the venturi between cylinders 11 and 12 to provide an approximate sealed region during commencement of combustion.

Figure 7:
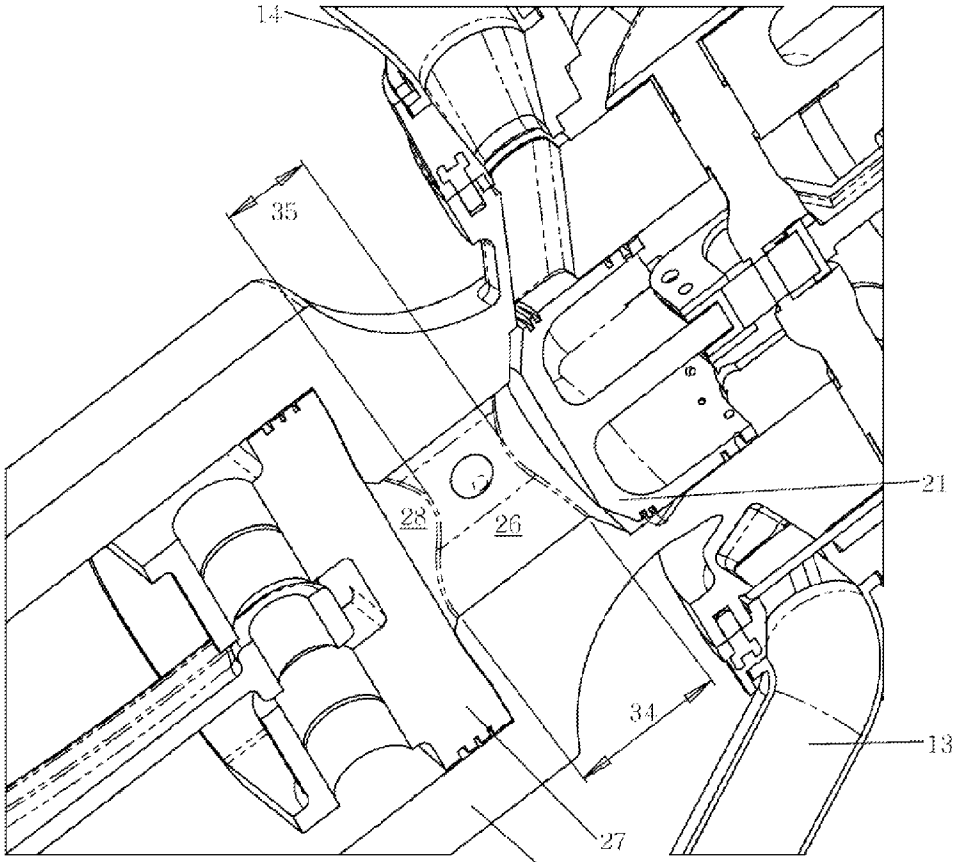
FIG. 7 is an isometric section view of a portion of the engine of FIG. 1 through the axis of the gudgeon or wrist pin of the first piston of the engine.
Figure 8:
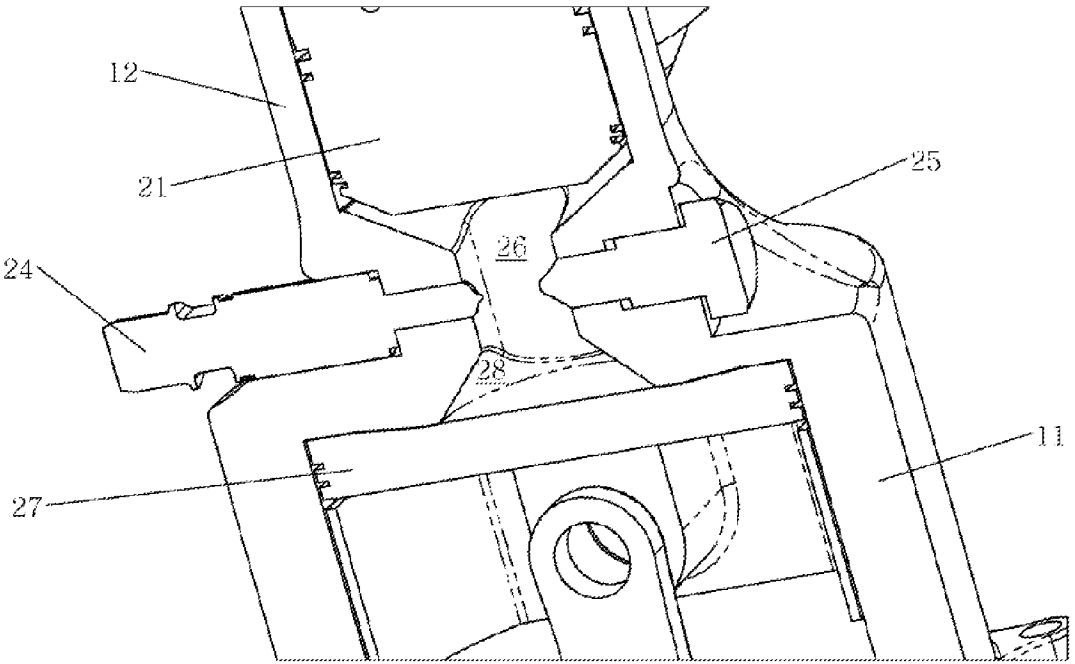
FIG. 8 is an isometric section view of the engine of FIG. 1, similar to but orthogonal to the view of FIG. 7.
Figure 9:
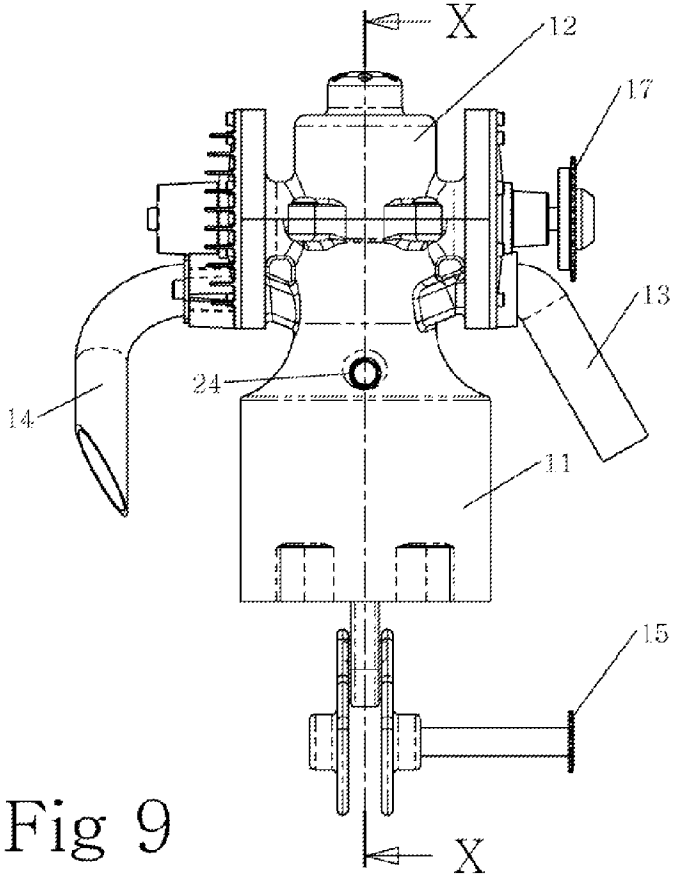
FIG. 9 is a side elevation similar to FIG. 4 with the first or bottom piston at 40° before to dead centre (BTDC)

From the views of FIGS. 7 and 8 the maximum and minimum dimensions 34, 35, respectively, of the depth of oval passage 26 as it extends between conical portions 28, 29 can be seen. Those dimensions necessarily arise due to the configuration of the intersection between passage 26 and the conical portions 28, 29. In the case where oval passage 26 is replaced by a circular bore the corresponding depth thereof will, in contrast, be a constant dimension.

In the depicted embodiment the injector 24 is located at the mid-point of minimum depth dimension of passage 26. This location corresponds to a position of substantially maximum velocity of the airflow within passage 26 during compression while aiding the creation of turbulent flow as the compressed air flows out of passage 26 into conical portion 28 upon movement of first piston 27 away from passage 26 during the power stroke of piston 27 under the action of combustion.

The embodiment as shown also incorporates a small compressor 33 formed at the opposite end of cylinder 12 to piston 21 and operated by crankshaft 18. Compressor 33 may be used for a number of purposes and could be employed to supply, say, up to 5% of the air required for the engine.

Figure 10:
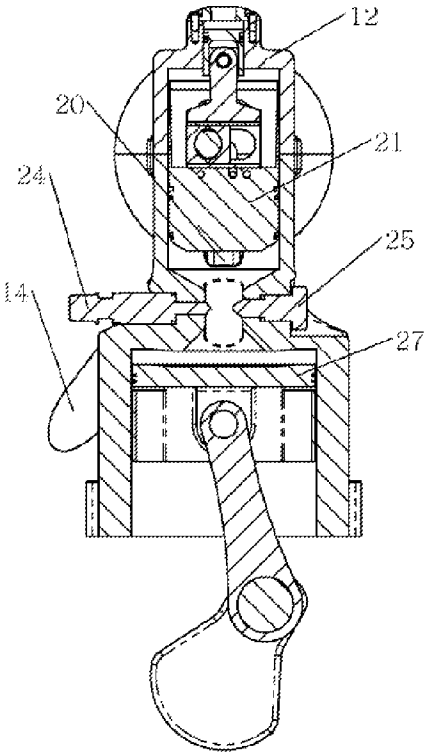
FIG. 10 is the section view X-X of FIGS. 9.
Figure 12:
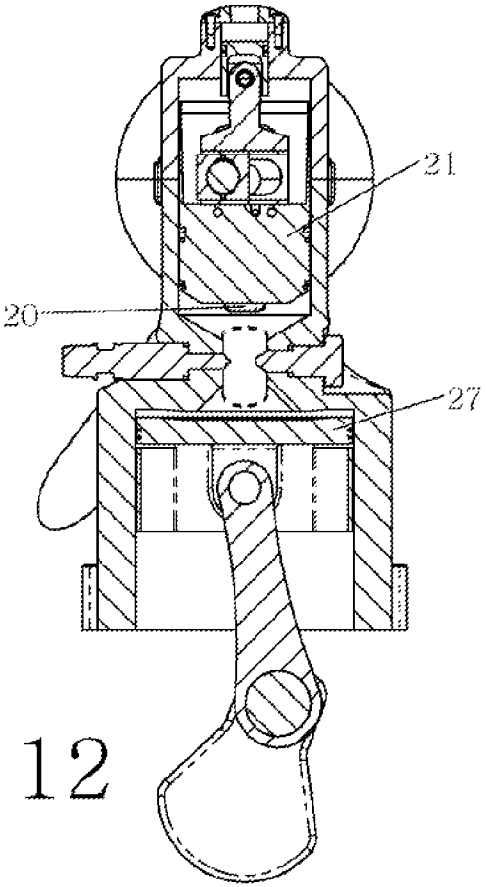
FIGS. 11-18 are similar to FIG. 10 but with the first piston at 30°, 20° and 10° BTDC, TDC, and 10°, 20°, 30° and 40° after top dead centre (ATDC), respectively.
Figure 11:
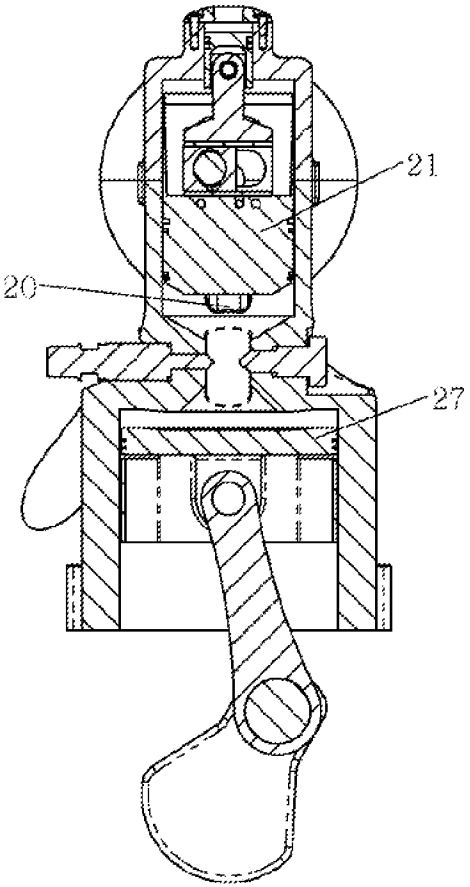
Figure 14:
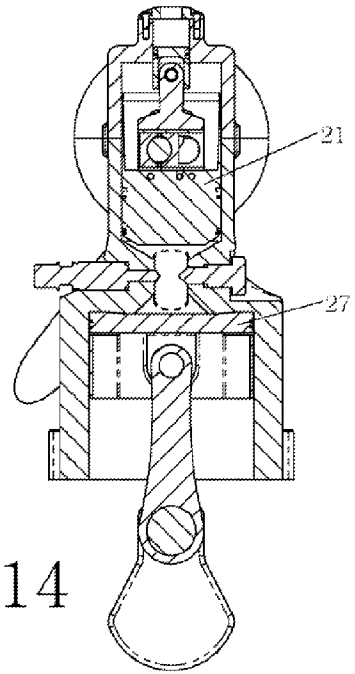
Figure 13:
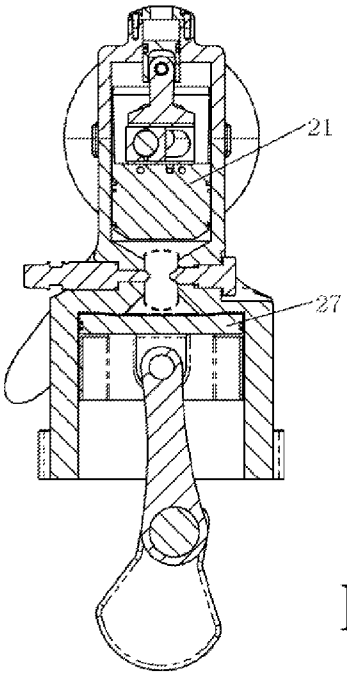
Figure 16:
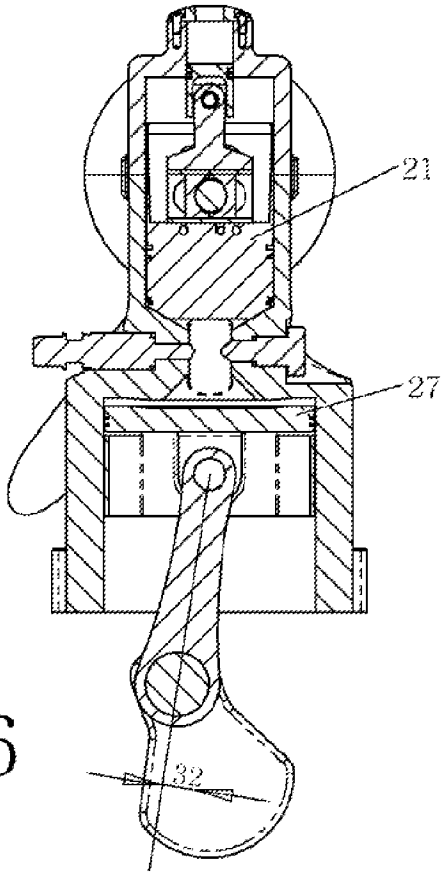
Figure 15:
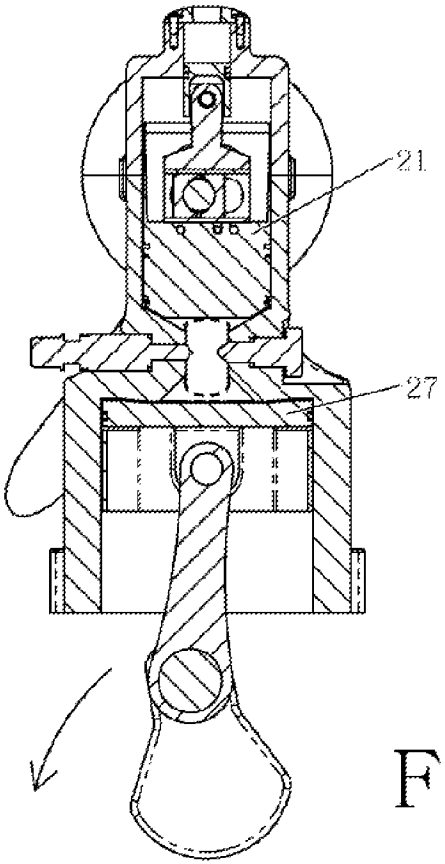
Figure 18:
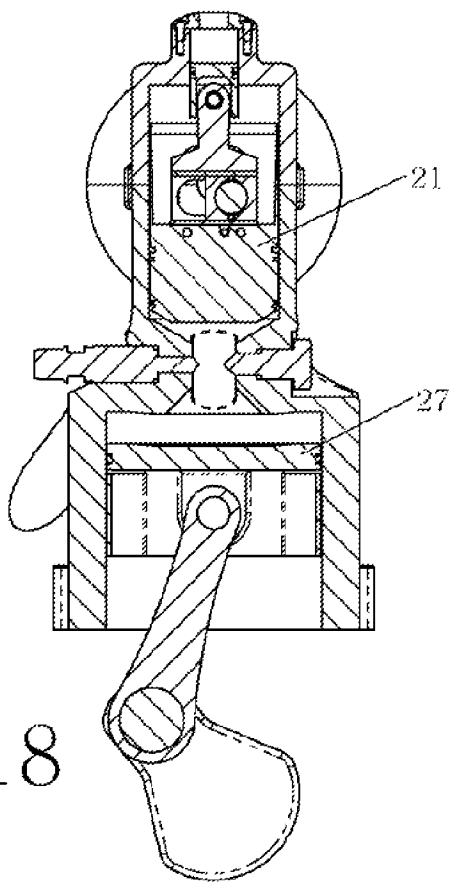
Figure 17:
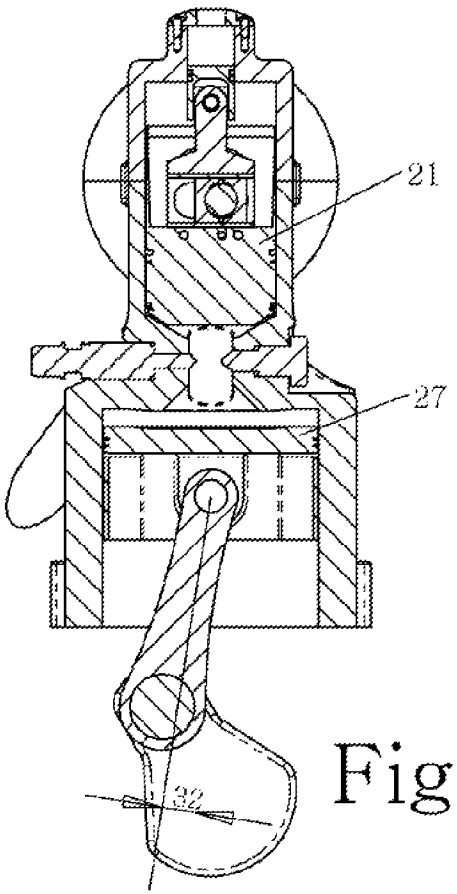

Referring now to FIG. 10 where piston 27 is shown at 40° BTDC, piston 21 is also proceeding towards its TDC with porting disc 23 having or nearly closed exhaust port 20 while piston 21 is yet to cover port 20. It will be appreciated that steps required to vary the engine timing are particularly convenient due to the ease of repositioning, of the chain drive between sprockets 15 and 17 and/or adjusting the relative positions of or using alternate rotary porting discs 22, 23. In a preferred assembly, discs 22, 23 are slidably mounted on splines on crankshaft 18 and secured by thrust bearings.

In FIGS. 11-18 it can be seen that motion of piston 21 lags that of piston 27 in movement towards their respective TDC positions while the dwell of piston 21 at its TDC continues from around 10° to 30° ATDC for piston 27.

Embodiments of the present invention lend themselves to use of multi event injectors with, say, up to five injections per power stroke. In operating the present embodiment, injector 24 fires a pilot shot at TDC of piston 27 and up to one more shot until piston 27 is 20° ATDC.

At 20° ATDC for piston 27, injector 24 tires its major fuel charge with perhaps an after shot to consume remaining gasses. At this time piston 21 is at its TDC with maximum pressure generated within the combustion chamber so allowing achievement of maximum torque by piston 27 as its associated crank arm 32 moves toward a maximum.

When piston 27 is 20° before bottom dead centre (BBDC) on the power stroke, piston 21 starts to uncover exhaust port 20 allowing exhaust gasses to flow through the venturi between cylinders 11 and 12. Exhaust port 20 remains open until piston 27 is again 20° ATDC at which time it is fully closed by rotating disc valve 23. During this phase the intake port 19 has opened via rotary disk valve 22 and piston 21 to allow intake air to be drawn in across piston 21 to scavenge cylinder 12 of spent gasses.

Intake port 19 remains open until piston 27 is 20° after bottom dead centre (ABDC) whereupon it is fully closed by disc valve 22. This timing provides maximum opportunity for use of a ram effect created by the pressure drop across the oval shaped zone of the venturi forming part of the combustion chamber. Thereafter compression and combustion follows as described above.

In the depicted embodiment the compression ratio is 16:1 but it will be appreciated that this arrangement provides great flexibility in designing engines for a wide range of compression ratios as poppet valves are not employed.

It is possible to have an air-cooled or liquid-cooled engine in accordance with the present invention.

Notwithstanding that the engine of the embodiment is naturally aspirated it may be provided with a supercharger or turbocharger.

When using a spark ignitable fuel it may be preferable to have a circular rather than oval chamber linking the contraction and expansion of the venturi between the first and second cylinders.

Notwithstanding the embodiment described it will be appreciated by persons skilled in the art that modifications and variations of the invention are possible without departing from the spirit or scope thereof as contemplated by the disclosure.

The invention claimed is:

1. An internal combustion engine comprising:

a first cylinder having a first piston movably positioned therein;

a second cylinder having a second piston movably positioned therein; and a venturi joining said first and second pistons such that induction air is forced through said venturi as said first piston and said second piston move toward each other during a compression stroke of the internal combustion engine, said venturi having a minimum cross-section that is oval shaped as viewed in a direction of gas flow between said first and second pistons so as to define a tuning region for intake fluid flow between said second and first pistons.

2. The internal combustion engine of claim 1, wherein said venturi leads into a first conical bore contracting toward said first piston to the minimum cross-section of the venturi as commencing from said second cylinder, said venturi having a second conical bore that expands from the minimum cross-section of the venturi so as to open into said first cylinder.

3. The internal combustion engine of claim 1, the minimum cross-section being in an oval-shaped passage of said venturi, said oval-shaped passage having a volume that is approximately one-third of a compressed volume of the internal combustion engine when said first piston is at a top dead center position.

4. The internal combustion engine of claim 1, the minimum cross-section being in an oval-shaped passage of said venturi, said oval-shaped passage being fitted with a pintle projecting thereinto, said pintle adapted to retain heat so as to assist combustion.

5. The internal combustion engine of claim 1, the minimum cross-section being in an oval-shaped passage of said venturi, the internal combustion engine further comprising:

a means for directly injecting fuel into said oval-shaped passage in a direction of a major axis of the oval shape.

6. The internal combustion engine of claim 4, further comprising:

a means for directly injecting fuel into said oval-shaped passage in a direction of a major axis of the oval shape but opposite to a direction of projection of said pintle.

7. The internal combustion engine of claim 2, said first piston having a head that is shaped so as to at least complementary fit within said second conical bore.

8. The internal combustion engine of claim 1, said second piston having a top which is inverted relative to said first piston, said top of said second piston being shaped as a frustum of a cone and adapted to mate with a complementary conical shape at a top of said second cylinder when said second cylinder is at a top dead center position.

9. The internal combustion engine of claim 8, said complementary conical shape at the top of said second cylinder being a portion of said venturi.

10. The internal combustion engine of claim 1, further comprising:

a means for charging said first and second cylinder with a fuel and air mixture such that the fuel and air are mixed within said venturi during each intake stroke of said first and second pistons.

11. The internal combustion engine of claim 10, further comprising:

a fuel injector adapted to inject fuel into an oval passage of said venturi between an expansion and contraction of the intake stroke.

* * * * *